US009285089B2

(12) United States Patent
Scott et al.

(10) Patent No.: US 9,285,089 B2
(45) Date of Patent: Mar. 15, 2016

(54) AUTOMATIC ELECTRICAL CONNECTION ASSEMBLY FOR LIGHT MODULES

(75) Inventors: Keith Scott, Livermore, CA (US); Todd Farmer, Livermore, CA (US)

(73) Assignee: Bridgelux, Inc., Livermore, CA (US)

( * ) Notice: Subject to any disclaimer, the term of this patent is extended or adjusted under 35 U.S.C. 154(b) by 249 days.

(21) Appl. No.: 12/975,209

(22) Filed: Dec. 21, 2010

(65) Prior Publication Data

US 2011/0090706 A1 Apr. 21, 2011

(51) Int. Cl.

| | |
|---|---|
| ***F21V 29/74*** | (2015.01) |
| ***F21S 8/08*** | (2006.01) |
| ***F21V 23/06*** | (2006.01) |
| ***F21V 29/00*** | (2015.01) |
| ***F21V 29/76*** | (2015.01) |
| *F21W 131/103* | (2006.01) |
| *F21Y 101/02* | (2006.01) |

(52) U.S. Cl.

CPC ..... *F21S 8/086* (2013.01); *F21V 23/06* (2013.01); *F21V 29/004* (2013.01); *F21V 29/76* (2015.01); *F21W 2131/103* (2013.01); *F21Y 2101/02* (2013.01)

(58) Field of Classification Search

CPC .... F21V 29/265; F21V 29/26; F21V 29/2293
USPC ..... 362/373, 294; 165/104.33
See application file for complete search history.

(56) References Cited

U.S. PATENT DOCUMENTS

| | | | | |
|---|---|---|---|---|
| 2,220,220 | A * | 11/1940 | Cusimano | 248/279.1 |
| 3,735,329 | A * | 5/1973 | Funabashi et al. | 439/323 |
| 5,199,784 | A | 4/1993 | Hempleman | |
| 5,531,181 | A * | 7/1996 | Cookingham | 116/288 |
| 6,422,716 | B2 * | 7/2002 | Henrici et al. | 362/235 |
| 6,880,952 | B2 * | 4/2005 | Kiraly et al. | 362/218 |
| 7,572,027 | B2 * | 8/2009 | Zampini et al. | 362/225 |
| 2004/0240229 | A1 * | 12/2004 | Blumel et al. | 362/555 |
| 2006/0262533 | A1 * | 11/2006 | Lin et al. | 362/249 |
| 2008/0105408 | A1 | 5/2008 | Zhang et al. | |
| 2008/0157112 | A1 * | 7/2008 | He et al. | 257/98 |
| 2008/0253121 | A1 * | 10/2008 | Chien | 362/250 |
| 2008/0285265 | A1 * | 11/2008 | Boissevain | 362/218 |
| 2009/0190356 | A1 * | 7/2009 | Kauffman | 362/282 |
| 2009/0237933 | A1 * | 9/2009 | Liu | 362/249.02 |
| 2009/0256459 | A1 * | 10/2009 | Liu | 313/12 |
| 2009/0261707 | A1 * | 10/2009 | Liu et al. | 313/46 |
| 2010/0014299 | A1 * | 1/2010 | Qin | 362/373 |
| 2010/0018672 | A1 | 1/2010 | Yang | |
| 2011/0186880 | A1 * | 8/2011 | Kohler et al. | 257/91 |

* cited by examiner

*Primary Examiner* — Julie Bannan
(74) *Attorney, Agent, or Firm* — Arent Fox LLP

(57) ABSTRACT

An illumination apparatus includes a solid state light emitting source and a first radiator thermally coupled to the solid state light emitting source, wherein the radiator is configured to be connectable to a second apparatus. The illumination apparatus further includes a one or more electrical conductors coupled to the radiator, wherein the electrical conductors are adapted to couple electrically to the solid state light emitting source.

22 Claims, 4 Drawing Sheets

AUTOMATIC ELECTRICAL CONNECTION ASSEMBLY FOR LIGHT MODULES

BACKGROUND

1. Field

The present disclosure relates to illumination devices. More particularly, the disclosure relates to automatically interconnecting solid state light emitting devices during assembly using an electrical bus.

2. Background

Solid state light emitting devices, such as light emitting diodes (LED)s, are attractive candidates for replacing conventional light sources such as incandescent, halogen and fluorescent lamps. LEDs have substantially higher light conversion efficiencies than incandescent and halogen lamps and longer lifetimes than all three of these types of conventional light sources. In addition, some types of LEDs now have higher conversion efficiencies than fluorescent light sources and still higher conversion efficiencies have been demonstrated in the laboratory. Finally, LEDs require lower voltages than fluorescent lamps and contain no mercury or other potentially dangerous materials, therefore, providing various safety and environmental benefits.

More recently, solid state devices have been used to replace high-intensity discharge (HID) lamps to provide high levels of light over large areas when energy efficiency and/or light intensity are required. These areas include roadways, parking lots, pathways, large public areas, and other outdoor applications. To increase the intensity of light in these applications, often more than one solid state light emitting device is arranged in a package. An example of a solid state light emitting device is a light emitting semiconductor chip comprising a p-n junction. An example of a package is a collection of light emitting devices arranged on a substrate and encapsulated in a phosphor to produce broad spectrum white light. This package is sometimes referred to as an "LED array." A heat sink is often attached to the LED array to dissipate heat generated by the light emitting devices.

Flexibility in designing street lighting for varying illumination requirements remains as one of the challenges in designing modular solid state light emitting devices for high luminance applications, and a modular solution to lamp design in such devices is beneficial. In particular, supplying power to a group of solid state light emitting devices in a modular assembly solution to build illumination arrays of different sizes and configurations is desirable.

SUMMARY

In an aspect of the disclosure, an illumination apparatus includes a solid state light emitting source and a first radiator thermally coupled to the solid state light emitting source, wherein the radiator is configured to be connectable to a second apparatus. The illumination apparatus further includes a one or more electrical buses coupled to the radiator, wherein the buses are adapted to couple electrically to the solid state light emitting device.

In another aspect of the disclosure, a solid state light emitting source includes a solid state light emitting device, and a carrier supporting the light emitting device, wherein the carrier is configured to be connectable to a first radiator. A first one or more electrical buses are coupled to the radiator, wherein the buses are adapted to couple electrically to the solid state light emitting device.

In another aspect of the disclosure, a heat sink module adapted to receive one or more solid state light emitting devices includes a base plate on which the light emitting devices are mounted, and a plurality of parallel heat pipes extending from opposite parallel first and second faces of the base plate. The plurality of parallel heat pipes extending from the first face are symmetrically offset in a direction in the plane of the one face from the heat pipes extending from the second face. A one or more heat dissipation fins are coupled to each of the heat pipes.

DETAILED DESCRIPTION

Figure 1:
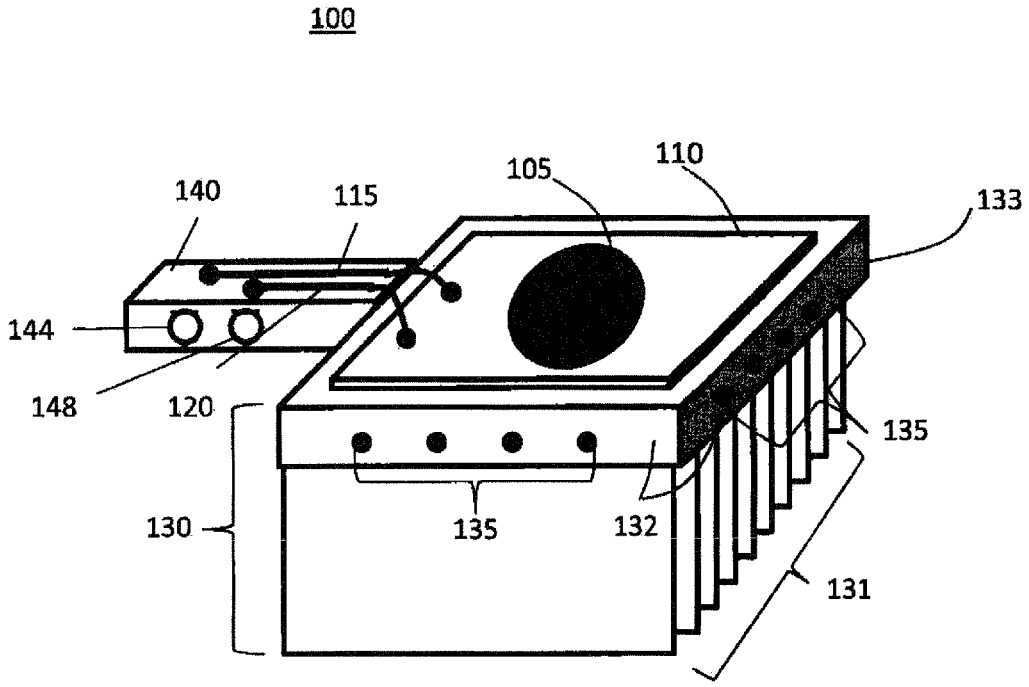
FIG. 1 shows a perspective view of an embodiment of an solid state light source for holding a solid state light emitting device in accordance with the disclosure.

The present invention is described more fully hereinafter with reference to the accompanying drawings, in which various aspects of the present invention are shown. For purposes of this disclosure, "street light" refers to any lighting system that provides any illumination to a street, road, walkway, tunnel, park, outdoor facility, parking lot, or the like. A "pole" refers any structure for supporting a lighting system, including, for example, a lamp post, hi-bay support, wall mounting, suspended hanging fixture, support frame, ceiling mount, or the like. A "thermal management system" may comprise at least one of a heat sink, heat spreader, heat fin, heat pipe, thermal interface material, active air movement devices, or the like. This invention, however, may be embodied in many different forms and should not be construed as limited to the various aspects of the present invention presented throughout this disclosure. Rather, these aspects are provided so that this disclosure will be thorough and complete, and will fully convey the scope of the present invention to those skilled in the art. The various aspects of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

Various aspects of the present invention will be described herein with reference to drawings that are schematic illustrations of idealized configurations of the present invention. As such, variations from the shapes of the illustrations as a result, for example, manufacturing techniques and/or tolerances, are to be expected. Thus, the various aspects of the present invention presented throughout this disclosure should not be construed as limited to the particular shapes of elements (e.g., regions, layers, sections, substrates, etc.) illustrated and described herein but are to include deviations in shapes that result, for example, from manufacturing. By way of example, an element illustrated or described as a rectangle may have rounded or curved features and/or a gradient concentration at its edges rather than a discrete change from one element to another. Thus, the elements illustrated in the drawings are schematic in nature and their shapes are not intended to illustrate the precise shape of an element and are not intended to limit the scope of the present invention.

It will be understood that when an element such as a region, layer, section, substrate, or the like, is referred to as being "on" another element, it can be directly on the other element or intervening elements may also be present. In contrast, when an element is referred to as being "directly on" another element, there are no intervening elements present. It will be further understood that when an element is referred to as being "formed" on another element, it can be grown, deposited, etched, attached, connected, coupled, or otherwise prepared or fabricated on the other element or an intervening element.

Furthermore, relative terms, such as "lower" or "bottom" and "upper" or "top," may be used herein to describe one element's relationship to another element as illustrated in the drawings. It will be understood that relative terms are intended to encompass different orientations of an apparatus in addition to the orientation depicted in the drawings. By way of example, if an apparatus in the drawings is turned over, elements described as being on the "lower" side of other elements would then be oriented on the "upper" side of the other elements. The term "lower", can therefore, encompass both an orientation of "lower" and "upper," depending of the particular orientation of the apparatus. Similarly, if an apparatus in the drawing is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and this disclosure.

As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

The detailed description set forth below in connection with the appended drawings is intended as a description of various aspects of the present invention and is not intended to represent all aspects in which the present invention may be practiced. The detailed description includes specific details for the purpose of providing a thorough understanding of the present invention. However, it will be apparent to those skilled in the art that the present invention may be practiced without these specific details. In some instances, well-known structures and components are shown in block diagram form in order to avoid obscuring the concepts of the present invention.

Various aspects of an illumination apparatus will now be presented. However, as those skilled in the art will readily appreciate, these aspects may be extended to other apparatus without departing from the spirit and scope of the invention. The illumination apparatus may include a series of solid state light sources mechanically connected serially to each other via radiators between the cells to manage heat removal generated during operation. The radiators may include arrays of heat fins coupled to heat pipes. The cell may include a carrier supporting a light emitting device. The light emitting device may be configured with one or more light emitting devices. The heat pipes may be arranged in the radiators to enable serial coupling of radiators and cells, either alternated or in any other combination to incorporate any selected number of cells and radiators to eliminate waste heat while providing illumination of a specified pattern and intensity.

Disclosed is an apparatus and method for solid state light emitting devices assembled in modules that may be mechanically connected serially to each other to provide automatic connectivity for electrical power. The module is a primary heat sinking structure supporting one or more solid state light emitting devices and/or arrays and providing connections for electrical power. Power may be provided to the solid state light emitting devices serially or in parallel, however parallel power is preferred. The heat pipes that connect adjacent modules include heat fins, forming a radiator, so that heat is rejected from the assembly of modules as parallel thermal loads, much as electrical power may be supplied to the solid state light emitting devices in parallel.

Power may be supplied by one or more electrical power buses that contain electrical wiring. The buses may be rigid, semi-rigid or flexible cables or conduits, for example. In one embodiment, a rigid conduit bus contains one or more insulated electrical wire paths. The bus may be supported in one of several ways by light illumination systems containing, for example, solid state light emitting devices assembled modules. The bus includes end connectors that couple two buses together and complete electrical connections between buses. The connectors are configured to couple to the solid state light sources, which may be positioned between two radiators. Arrays of electrically connected solid state light sources and radiators may be assembled in one-, two, and three dimensions.

An example of a solid state light emitting device is the LED. The LED is well known in the art, and therefore, will only briefly be discussed to provide a complete description of the invention. An LED is a semiconductor material impregnated, or doped, with impurities. These impurities add "electrons" and "holes" to the semiconductor, which can move in the material relatively freely. Depending on the kind of impurity, a doped region of the semiconductor can have predominantly electrons or holes, which is referred to as n-type or a p-type semiconductor region, respectively. In LED applications, the semiconductor includes an n-type semiconductor region and a p-type semiconductor region. A reverse electric field is created at the junction between the two regions, which cause the electrons and holes to move away from the junction to form an active region. When a forward voltage sufficient to overcome the reverse electric field is applied across the p-n junction, electrons and holes are forced into the active region and combine. When electrons combine with holes, they fall to lower energy levels and release energy in the form of light.

LEDs are available in a range of colors of relatively narrow bandwidth. However, in applications where it is desirable to simulate illumination spectral properties representative of "white light" produced by incandescent, fluorescent, halogen or natural sunlight, one solution is to include one or more phosphors in a carrier encapsulating, or as a layer above, a blue LED. The phosphors absorb a portion of the short wavelength blue light and emit longer wavelengths of light by a process of Stokes shift emission. By controlling the type and amount of phosphor a balanced mix of light emitted by the LED directly and the phosphor is perceive by the human eye as "white light."

FIG. 1 shows a perspective view of an embodiment of a solid state light source 100 for holding and operating at least one solid state light emitting device 105. The solid state light emitting device 105 may include a single LED (not shown) or an array of LEDs (not shown). The solid state light emitting device 105 can be mounted on a plate 110 which can be further attached to a carrier 130. Wires 115, 120 may be attached to solid state light emitting device 105 via the plate 110 to excite solid state light emitting device 105 to emit light from a power source (not shown). Carrier 130 includes a thermal heat sink 133. Carrier 130 may include heat fins 131 to radiate waste heat, which may be located, for example, on the underside of the carrier 130 thermal heat sink 133. Carrier 130 may further include holes 135 on sides 132 of the thermal heat sink 133 into which may be received one or more heat pipes (described below) which may be used to conduct additional waste heat from carrier 130.

A bridge 140 supports wires 115, 120, which make conductive contact with connector ports 144, 148 adapted to couple to electrical conductors (described below).

Figure 2A:
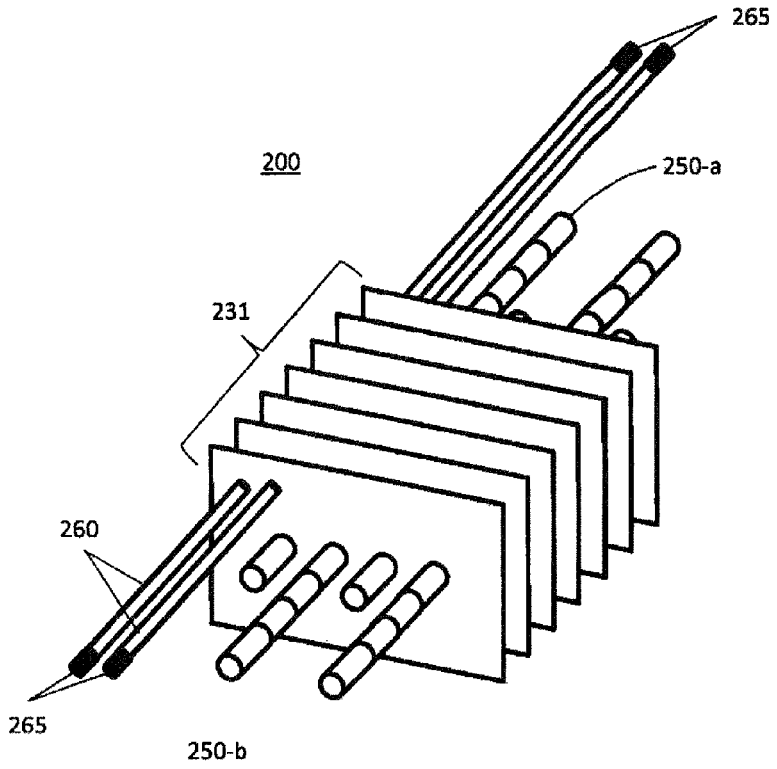
FIG. 2A shows a perspective view of an embodiment of a radiator including electrical buses for use with the solid state light source of FIG. 1 in accordance with the disclosure.
Figure 2B:
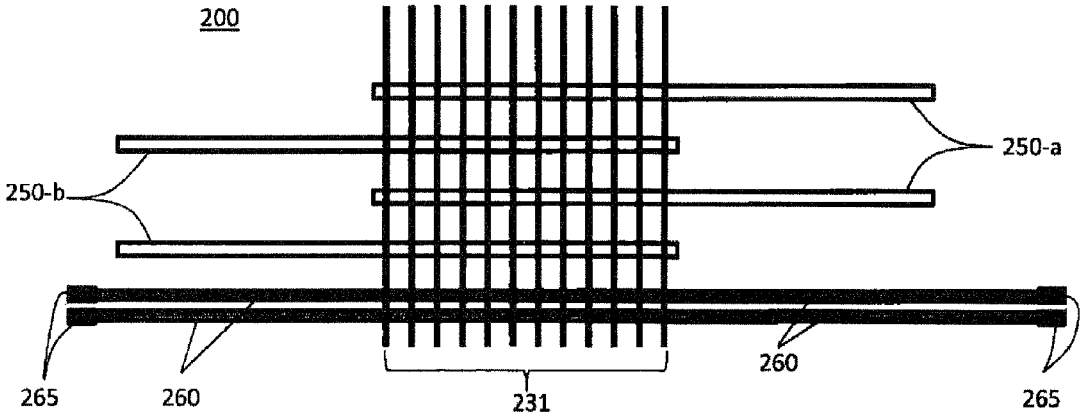
FIG. 2B shows a plan view of the radiator of FIG. 2A.

FIG. 2A shows a perspective view of an embodiment of a radiator 200 for use with the solid state light source 100 of FIG. 1. FIG. 2B shows a plan view of the radiator 200 of FIG. 2A. In an embodiment, the radiator 200 includes an array of parallel fins 231 for radiating heat ducted to the fins via the heat pipes 250. The heat pipes 250 typically comprise high thermal conductivity metals or other material for efficient transfer of heat, and are well known in the art. In an embodiment, the radiator 200 includes a first one or more heat pipes 250-*a* extending farther from one side, and a second one or more of heat pipes 250-*b* that extend farther from the opposite side. In the exemplary illustration of FIGS. 2A-2B, the heat pipes 250-*a* and 250-*b* are shown as a pair of heat pipes, respectively, but there may be fewer or more heat pipes 250 in a radiator and fewer or more corresponding holes 135 in the carrier 130. Referring to the example illustrated in FIGS. 2A-2B, the two pairs of heat pipes 250-*a*, 250-*b* are interlaced, so that adjacent heat pipes 250 extend from opposite ends of the radiator 200. The first pair of heat pipes 250-*a* may be arranged to be inserted into an alternating pair of holes 135 on a first face 132 of the carrier 130. Passing through, and supported by the fins 231 are one or more electrical conductors 260. The electrical conductors 260 may be insulated and carry one or more insulated electrical wires. The electrical conductors 260 may be terminated at each end with a connector 265 to be received by the connector ports 144, 148. When a radiator 200 is assembled to an solid state light source 100, positioning of the heat pipes 250 and electrical conductors 260 in the radiator 200 is chosen so that a selected one or more heat pipes, e.g. 250-*a*, mate with a corresponding pair of holes 135 in the carrier 130, while the electrical conductors 260, mate with the connector ports 144, 148 in the bridge 140, where the electrical conductors 260 may mate with the connector ports 144, 148 via connectors 265. Thus, both thermal and electrical connections are made in the assembly process.

Figure 3:
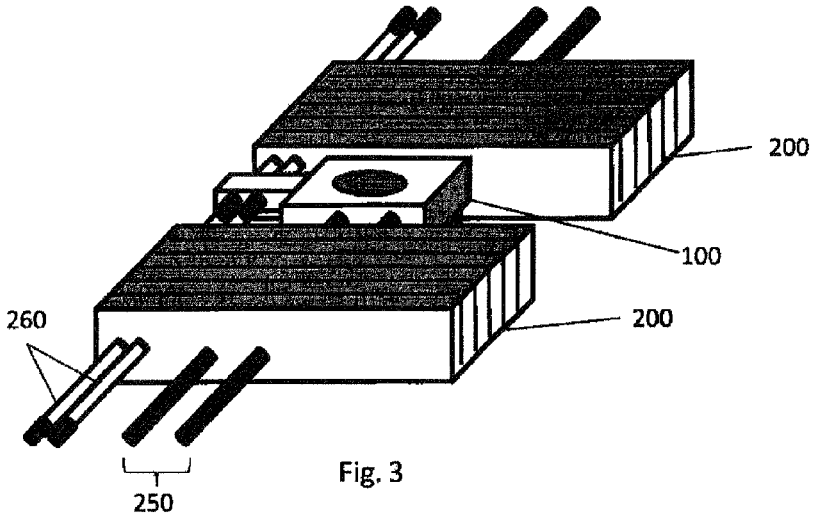
FIG. 3 shows a perspective view of an embodiment of an solid state light source assembled in series with two radiators, electrically connected via the electrical buses in accordance with the disclosure.

FIG. 3 shows a perspective view of an embodiment of an illumination apparatus 300 having a solid state light source 100 between two radiators 200, illustrating how the assembly of solid state light sources 100 and radiators 200 simultaneously achieves a structure to provide electrical power to a solid state light emitting device 105 and removal of waste heat generated by the solid state light emitting device 105.

Figure 4:
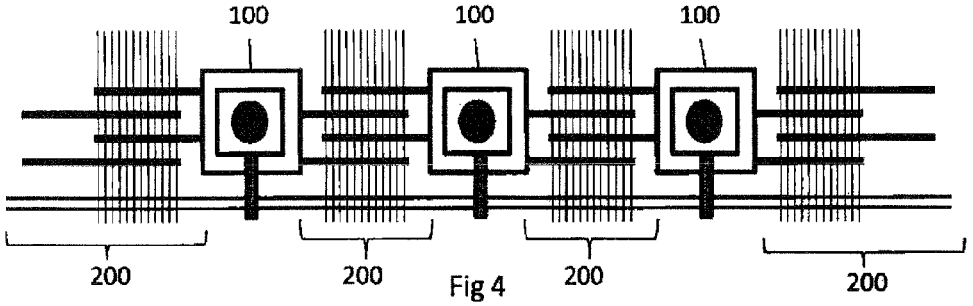
FIG. 4 shows a plan view of solid state light sources and radiators assembled in a serial array, including electrical connection with electrical buses in accordance with the disclosure.

Larger illumination structures can be assembled. FIG. 4 shows a plan view of solid state light sources 100 and radiators 200 assembled in a one-dimensional serial array of arbitrary size. The purpose of the offset between heat pipes 250-*a* and 250-*b* may be appreciated with reference to FIG. 4. The radiators 200 may be coupled to either side of an solid state light source 100 while the electrical conductors 260 remain on a same side for continuous connection of serially attached alternating radiators 200 and solid state light sources 100.

Figure 5:
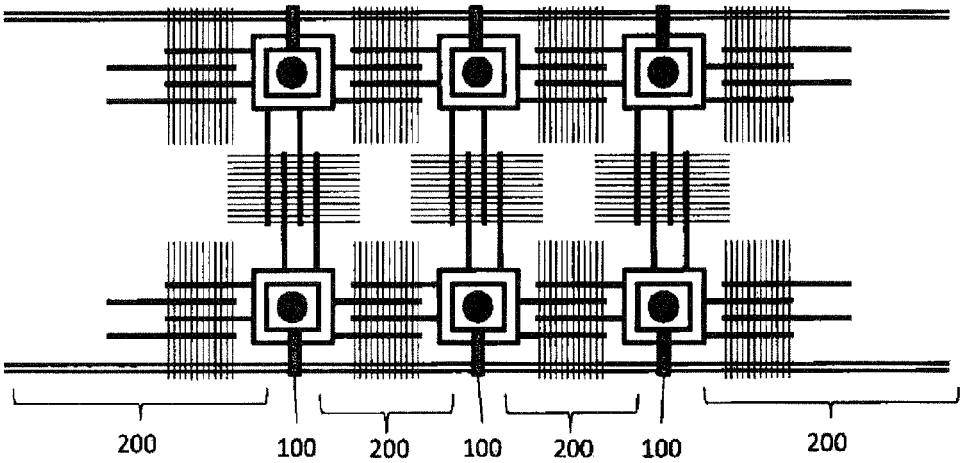
FIG. 5 shows a plan view of solid state light sources and radiators assembled in a 2-dimensional array, including electrical connection with electrical buses in accordance with the disclosure.

FIG. 5 shows a plan view of solid state light sources 100 and radiators 200 assembled in a 2-dimensional array. By appropriately bending the heat pipes 250 and electrical conductors 260, three-dimensional assemblies, radiating light in three dimensions may be achieved.

Figure 6:
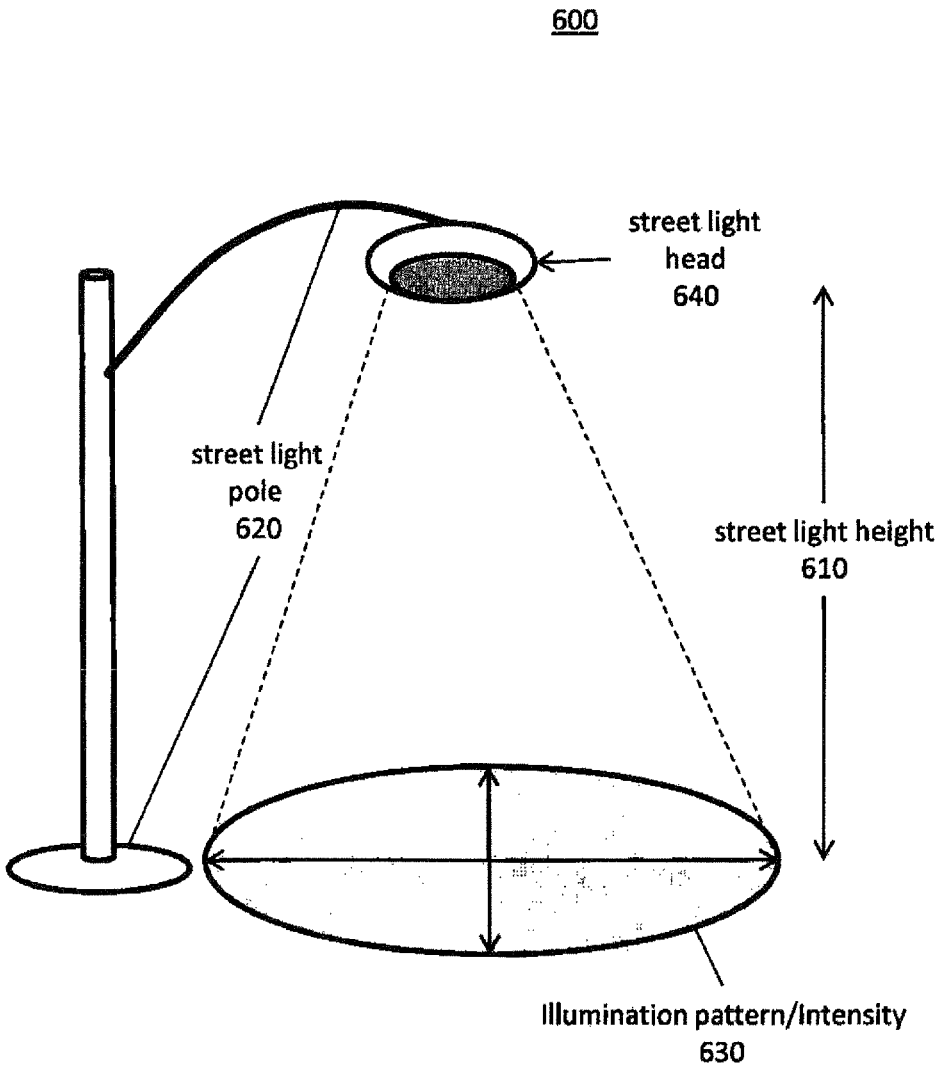
FIG. 6 illustrates various aspects street light illumination distribution patterns.

The foregoing described combinations of solid state light sources 100 and radiators 200 may be implemented in street lights. FIG. 6 illustrates various aspects street light illumination distribution patterns. Namely, given the height 610 of the lamp pole 620, the required illumination pattern and intensity 630, a combination and configuration of solid state light sources 100 and radiators 200 included in the street light head 640 may be chosen to meet the lighting requirements.

It is to be understood that the specific order or hierarchy of steps in the methods disclosed is an illustration of exemplary processes. Based upon design preferences, it is understood that the specific order or hierarchy of steps in the methods may be rearranged. The accompanying method claims present elements of the various steps in a sample order, and are not meant to be limited to the specific order or hierarchy presented unless specifically recited therein.

The claims are not intended to be limited to the various aspects of this disclosure, but are to be accorded the full scope consistent with the language of the claims. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A modular illumination apparatus comprising:

one or more solid state light emitting devices; and first and second radiators thermally coupled to the one or more solid state light emitting devices, wherein the first and second radiators each comprise an array of heat dissipation fins, wherein the first radiator is adjacent to a first side of the one or more solid state light emitting devices and the second radiator is adjacent to a second side of the one or more solid state light emitting devices, and wherein the one or more solid state light emitting devices, first radiator, and second radiator are coplanar; and one or more electrical conductors configured to pass through at least one of the arrays of heat dissipation fins by passing transversely through a surface of at least one heat dissipation fin of said at least one of the arrays of heat dissipation fins, the one or more electrical conductors further configured to electrically couple to the one or more solid state light emitting devices.

2. The illumination apparatus of claim 1, wherein the one or more solid state light emitting devices comprise one or more connector ports configured to electrically couple to the one or more electrical conductors.

3. The illumination apparatus of claim 1, wherein the one or more solid state light emitting devices comprise one or more connector ports, and wherein each of the one or more electrical conductors includes a connector configured to plug into one of the one or more connector ports.

4. The illumination apparatus of claim 1, further comprising a carrier supporting the one or more solid state light emitting devices, wherein the carrier comprises one or more holes and at least one of the first and second radiators comprises one or more heat pipes extending into the one or more holes in the carrier.

5. The illumination apparatus of claim 1, wherein the one or more electrical conductors in the first radiator is electrically coupled to the one or more electrical conductors in the second radiator.

6. The illumination apparatus of claim 1, further comprising a carrier supporting the one or more solid state light emitting devices, wherein the one or more electrical conductors in the first radiator and the one or more electrical conductors in the second radiator are electrically coupled to the one or more solid state light emitting devices.

7. A street light comprising:

a pole; and a head coupled to the pole, the head comprising:

one or more solid state light emitting devices;

first and second radiators thermally coupled to the one or more solid state light emitting devices, wherein the first and second radiators each include an array of heat dissipation fins, and wherein the first radiator is adjacent to a first side of the one or more solid state light emitting devices and the second radiator is adjacent to a second side of the one or more solid state light emitting devices, and wherein the one or more solid state light emitting devices, first radiator, and second radiator are coplanar; and one or more electrical conductors configured to pass through at least one of the arrays of heat dissipation fins by passing transversely through a surface of at least one heat dissipation fin of said one of the arrays of heat dissipation fins, the one or more electrical conductors further configured to electrically couple to the one or more solid state light emitting devices.

8. The street light of claim 7, further comprising an arm supported by the pole and the head supported by the arm.

9. A modular illumination apparatus comprising:

one or more solid state light emitting devices;

first and second radiators thermally coupled to the one or more solid state light emitting devices, wherein the first and second radiators each comprise an array of heat dissipation fins, and wherein the first radiator is adjacent to a first side of the one or more solid state light emitting devices and the second radiator is adjacent to a second side of the one or more solid state light emitting devices, and wherein at least one of the fins of the first radiator is transverse to at least one of the fins of the second radiator; and one or more heat pipes coupled to the first radiator, wherein the one or more heat pipes are configured to provide the thermal coupling between the first radiator and the one or more solid state light emitting devices; and a plurality of heat pipes coupled to the second radiator, wherein at least one of said plurality heat pipes is configured to provide thermal coupling between said second radiator and said solid state light emitting devices, and wherein at least another one of said plurality of heat pipes is configured to provide a thermal coupling between said second radiator and another one or more solid state light emitting devices adjacent to said second radiator.

10. The modular illumination apparatus of claim 9, wherein the one or more solid state light emitting devices comprise one or more connector ports configured to electrically couple to one or more electrical conductors.

11. The modular illumination apparatus of claim 10, wherein each of the one or more electrical conductors includes a connector configured to plug into one of the one or more connector ports.

12. The modular illumination apparatus of claim 9, further comprising a carrier supporting the one or more solid state light emitting devices, wherein the carrier comprises one or more holes, and wherein the one or more heat pipes extend into the one or more holes in the carrier.

13. The modular illumination apparatus of claim 10, further comprising a third radiator adjacent to a third side of the one or more solid state light emitting devices, wherein at least one of the one or more electrical conductors passes transversely through the first radiator and another at least one of the one or more electrical conductors passes transversely through the third radiator, and wherein the at least one of the electrical conductors that passes through the first radiator is electrically coupled to the one or more electrical conductors that passes through the third radiator via the connector ports.

14. The modular illumination apparatus of claim 13, further comprising a carrier supporting the one or more solid state light emitting devices, wherein the one or more electrical conductors in the first radiator and the one or more electrical conductors in the third radiator are electrically coupled by assembly to connect to the one or more solid state light emitting devices via the carrier.

15. The apparatus of claim 1, wherein the electrical conductors are rigid and extend beyond the at least one of said first and second radiators to couple physically with the one or more solid state light emitting devices to complete an electrical connection.

16. The modular illumination apparatus of claim 13, wherein the first, second, and third radiators are coplanar.

17. The modular illumination apparatus of claim 16, wherein the connector ports are positioned on a fourth side of the one or more solid state light emitting devices.

18. The modular illumination apparatus of claim 2, further comprising a third radiator adjacent to a third side of the one or more solid state light emitting devices, wherein at least one of the one or more electrical conductors passes transversely through the first radiator and another at least one of the one or more electrical conductors passes transversely through the second radiator, and wherein the at least one of the electrical conductors that passes through the first radiator is electrically coupled to the one or more electrical conductors that passes through the second radiator via the connector ports.

19. The modular illumination apparatus of claim 18, wherein the connector ports are positioned on a fourth side of the one or more solid state light emitting devices.

20. The modular illumination apparatus of claim 18, wherein the third radiator comprises an array of heat dissipation fins transverse to the arrays of heat dissipation fins of the first radiator and second radiator.

21. The modular illumination apparatus of claim 18, wherein the at least one of the heat dissipation fins of the third radiator runs parallel to at least one of the electrical conductors.

22. The modular illumination apparatus of claim 18, wherein the first, second, and third radiators are coplanar.

* * * * *